United States Patent [19]

Hammon

[11] 4,438,812

[45] Mar. 27, 1984

[54] BRUSH TOOL FOR WELLS

[76] Inventor: Donald P. Hammon, 75 E. Mountain View St., Long Beach, Calif. 90805

[21] Appl. No.: 410,815

[22] Filed: Aug. 23, 1982

[51] Int. Cl.[3] ..... F21B 41/00

[52] U.S. Cl. ..... 166/173; 15/104.2; 15/183; 15/200

[58] Field of Search ..... 166/170, 173, 176; 15/179, 183, 200, 197, 198, 104.2, 204, 171

[56] References Cited

U.S. PATENT DOCUMENTS

| | | | |
|---|---|---|---|
| 1,342,618 | 6/1920 | Bashara | 166/173 |
| 1,438,371 | 12/1922 | Fletcher | 15/204 |
| 1,996,544 | 4/1935 | Justice | 15/183 |
| 3,355,758 | 12/1967 | Clark | 15/179 UX |
| 3,357,038 | 12/1967 | Williamson | 15/183 |
| 3,827,492 | 8/1974 | Hammon | 166/173 |

*Primary Examiner*—Ernest R. Purser
*Assistant Examiner*—Timothy David Hovis
*Attorney, Agent, or Firm*—Ralph B. Pastoriza

[57] ABSTRACT

A mandrel is provided for insertion in a well pipestring. First and second semi-cylindrical sections, in turn, are arranged to be brought together from opposite sides of the mandrel to surround the mandrel in coaxial relationship. Each of these semi-cylindrical sections has holes supporting wire brushes, the brushes being held secure when the semi-cylindrical sections are fitted about the mandrel. End ring members are received over the opposite ends of the mandrel to engage about the ends of the semi-cylindrical sections and hold them securely together. Appropriate collar members threaded on the ends of the mandrel in turn will hold the ring members axially in place and also serve to connect the mandrel to the pipe string. The mandrel itself has a central bore sufficient to maintain the normal circulation or reverse circulation during a brushing operation and the semi-cylindrical sections holding the brushes can be easily removed and replaced as required.

5 Claims, 3 Drawing Figures

BRUSH TOOL FOR WELLS

FIELD OF THE INVENTION

This invention relates generally to tools for brushing wells and more particularly to an improved tool preferably for cleaning oil wells.

BACKGROUND OF THE INVENTION

Brushing tools for oil wells are well known in the art. Generally, these devices comprise a mandrel having radially extending brushes which may take the form of stiff bundles of wire which engage the interior walls of the oil well casing and/or perforations to be brushed or cleaned. A major problem associated with such devices is to assure that the radially extending brush elements are properly secured to the mandrel. In the event hard encrustations are encountered in the well casing, the brushes can become bent or broken off, or in some other manner disconnected from the mandrel itself and become lost in the bore hole.

Some proposed solutions to the above problem include providing a solid mandrel with diametric holes passing therethrough, the bundles of stiff wires in turn simply diametrically passing through the solid mandrel and extending radially from each end. This type of construction provides a very secure support for the wire brushes. On the other hand, the brushes are very difficult to replace if they become worn. A more serious problem is the fact that the solid mandrel will not permit circulation of fluid to be maintained during a brushing operation. While the circulation problem can be alleviated by providing a central bore in the mandrel for permitting circulation, the wire elements of the brushes diametrically criss-crossing the central bore impede the flow of such circulation.

Still other problems are encountered in that any openings or holes made to receive the bundle of wires forming the brushes tend to become worn as the tool is used. The wires themselves are of hard material and will tend to elongate radial holes from which the wires extend after repeated up and down brushing operations on the well casing surfaces.

In my U.S. Pat. No. 3,827,492 issued Aug. 6, 1974, I have provided an improved oil well brush tool which overcomes several of the foregoing problems. Essentially, the brush of this patent includes a mandrel with a central bore so that circulation can be maintained and a plurality of individual rings which surround the mandrel and support bundles of wires. While my tool shown in this patent will function to clean wells, the problem of the bundle of wires bearing against the openings in the individual rings as the brushes scrape along the side walls of the well result in elongation of the openings or a wearing away thereof. Further, the rings themselves must be sufficiently thick to provide adequate support for the bundles of wires and this thickness necessarily results in a reduction of the outside and inside diameters of the mandrels which the rings surround. As a consequence, effective circulation is somewhat impaired, although greatly improved over the heretofore noted other prior art devices. In addition, in the case of a plurality of rings as described in my above-referred to patent, there is involved a fairly lengthy amount of time to assemble and disassemble the brush tool.

BRIEF DESCRIPTION OF THE PRESENT INVENTION

With the foregoing considerations in mind, the present invention contemplates a greatly improved brush tool for wells which retains the advantages set forth in my prior mentioned U.S. patent, but also prevents wear on holes supporting bundles of wires making up the brushes and provides for better circulation during a brushing operation. Also, the present invention is so constructed as to be easily assembled and disassembled when it is desired to replace the brushes.

In accord with the invention in its broadest aspect, a mandrel is provided for insertion in a well pipestring, the mandrel having a central bore for maintaining normal well fluid circulation during a brushing operation. First and second semi-cylindrical sections, each having a plurality of holes along its length, are provided. Bent brush means in turn radially extend through these holes, the brush means including a rivet-shaped collar which protects direct contact of the wire brushes with the holes so that wear is minimized. The first and second semi-cylindrical sections are dimensioned to surround the mandrel in coaxial relationship when brought together from opposite sides of the mandrel so that the inner bent ends of the brush means are held secure between the outer wall of the mandrel and the inner walls of the first and second semi-cylindrical sections. Ring means receivable over the ends of the mandrel are provided to engage about the opposite ends of the semi-cylindrical sections and thereby hold them together about the mandrel. The normal collars on the ends of the mandrel for securement to the pipestring serve to hold the ring means in place.

With the foregoing arrangement, the brush elements can readily be replaced by simply removing the semi-cylindrical sections which serve to support all of the brush elements along the length of the mandrel. This operation involves only removing the end rings. Moreover, the construction is such that a normal sized internal central bore in the mandrel can be used so that proper fluid circulation can be maintained during a brushing operation.

BRIEF DESCRIPTION OF THE DRAWINGS

A better understanding of this invention will be had by now referring to a preferred embodiment as illustrated in the accompanying drawings in which.

DETAILED DESCRIPTION OF THE PREFERRED EMBODIMENT

Figure 1:
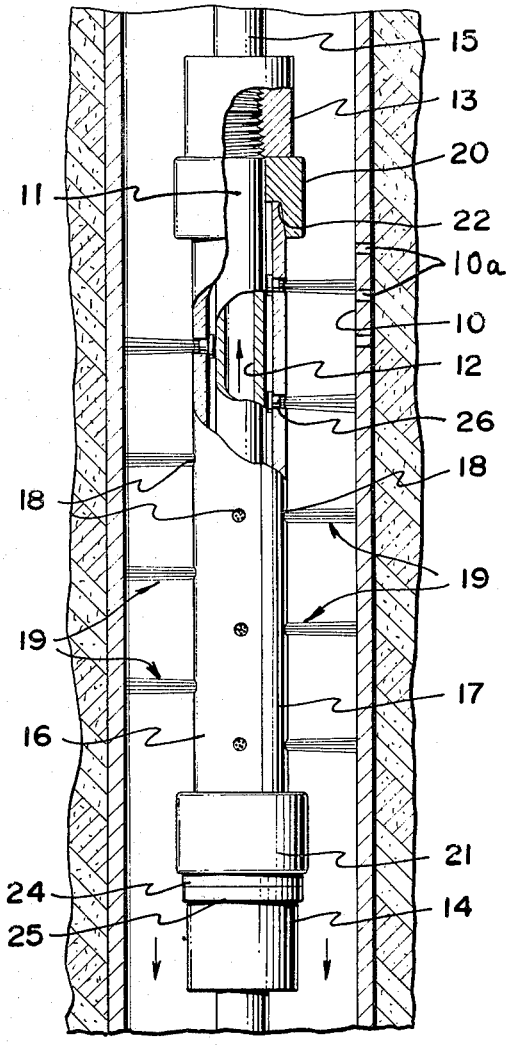
FIG. 1 is a side elevational view partly broken away and partly in cross section of the brush tool of this invention in an oil well.

Referring first to FIG. 1, there is shown, by way of example, an oil well casing 10 with perforations 10*a* to be cleaned by the well brush of this invention. The brush itself includes a mandrel 11 having a central bore 12 for maintaining well fluid circulation as shown in the cut-away portion.

End collars 13 and 14 threaded to the ends of the mandrel 11 permit connection of the mandrel into a conventional pipestring for the well.

Figure 2:
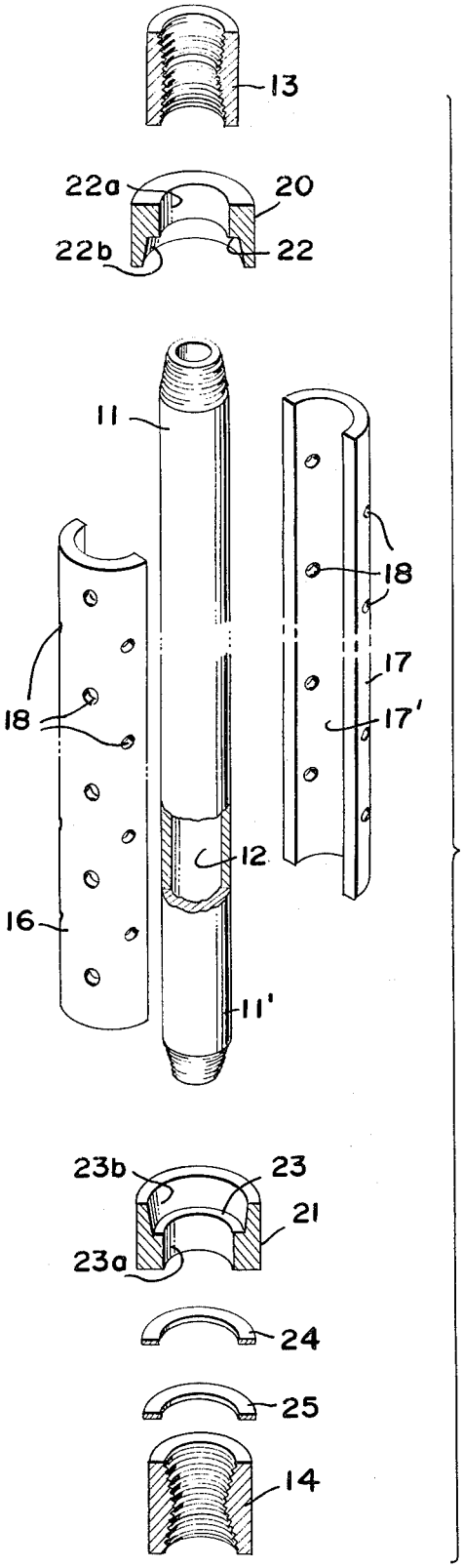
FIG. 2 is an exploded perspective view of the basic components making up the brush tool of FIG. 1, some of the components being illustrated in cross section; and, FIG. 3 is a fragmentary exploded perspective view of one of the brush means shown in FIG. 1, illustrating details of the invention.

Referring to both FIGS. 1 and 2, the brush tool further includes first and second semi-cylindrical sections 16 and 17 each having a plurality of holes 18 along its length. Brush means 19, in turn, radially extend through the holes 18 as shown in FIG. 1, the first and second sections being dimensioned to surround the mandrel 11 in coaxial relationship when brought together from opposite sides of the mandrel. With this arrangement the inner ends of the brush means are held secure between the outer wall 11' of the mandrel and the inner walls such as indicated at 17' of the first and second semi-cylindrical sections.

The assembly is completed by the provision of ring members 20 and 21 receivable over the ends of the mandrel 11 to engage about the opposite ends of the semi-cylindrical sections 16 and 17 and thereby hold these sections together about the mandrel as best shown in FIG. 1.

In the specific embodiment disclosed, each of the ring members includes a stepped bore defining an axially facing annular shoulder 22 for the ring member 20 and 23 for the ring member 21 These annular shoulders seat against the ends of the semi-cylindrical sections when the ring members are received thereover. It will be understood that the end collars 13 and 14 after threading on the opposite ends of the mandrel 11 hold the adjacent ring members 20 and 21 in place.

With respect to the foregoing, it will be noted that each of the ring members includes central bore portions **22*a* and 22*b* for the ring member 20 and 23*a* and 23*b* for the ring member 21, divided by the annular shoulders 22 and 23 respectively. The larger bore portions such as 22*b* and 23*b*** between the annular shoulder and end of the ring member surrounding the ends of the semi-cylindrical sections are tapered so as to exert a radial squeezing force on the ends of the sections as the ring members are moved axially thereover by force exerted by the collars. The sections are thus secured in tight radial engagement about the mandrel.

With specific reference to FIG. 2, it will be noted that there are provided spacing washers 24 and 25 associated with the one ring member 21 receivable between this ring member and the adjacent collar 14. These washers which are shown in place in FIG. 1 allow for axial adjustment of the collar position on the mandrel and thereby enable a tight axial engagement of the collar against the adjacent ring member to be made. In other words, the threaded extent of axial movement of the collar 14 on the lower threads of the mandrel 11 is limited by the number of threads. To take up for any tolerances in the overall length of the semi-cylindrical sections 16 and 17, the washers 24 and 25 or even additional washers may be provided to assure that an axial "squeezing" of the semi-cylindrical sections between the ring members 20 and 21 takes place.

Figure 3:
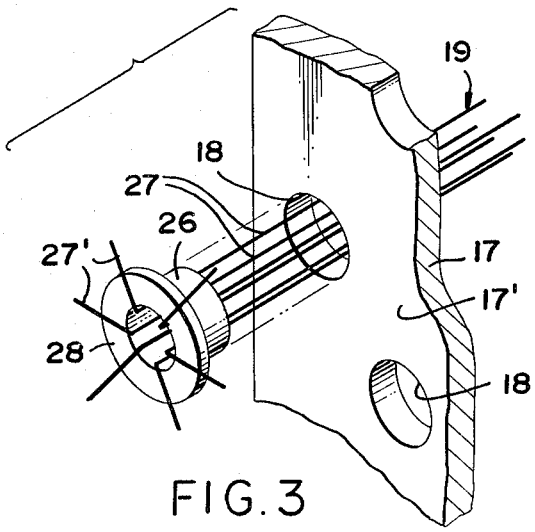

Referring now to FIG. 3, details of the brush means 19 described briefly in FIG. 1 are shown. Since all of the brush means are identical, a detailed description of one will suffice for all. Essentially, the brush means include a brush bundle 19 for each hole 18 comprising a rivet shaped collar and a plurality of wires passing through the collar to make up the brush bundle. This rivet shaped collar includes a cylindrical portion 26 dimensioned to be snugly received in the hole 18 and of an axial length sufficient to hold the wires in a bundle. The plurality of wires is shown at 27 passing through this cylindrical portion. The rivet-shaped collar itself includes a radially extending exterior flange 28 at one end overlapping the entrance periphery of the hole 18 when the rivet-shaped collar is received in the hole 18. The plurality of wires 27 have their inner ends bent laterally to overlie this flange as indicated at 27'. This bending of the wires constitutes an important feature of the present invention and serves to trap the wires so that they cannot be pulled out through the openings.

With the foregoing arrangement, it will be evident that the rivet-shaped collar serves two functions. First, it serves as a holder for the bundle of wires 27 for easy handling and insertion through the holes 18. Second, it serves to separate the wires from the edges of the holes 18 and thus prevent direct contact of the wires with the holes and thereby minimizes wear on the holes and simultaneously prevents the wires from fanning out; that is, the axial extent if the rivet is sufficient to keep the wires in a tight bundle. The wires themselves are made of very hard metal and action of the wires against the edges of the hole could cause elongation of the hole as the entire tool is moved up and down the well bore. The provision of the rivet-shaped collar cylindrical portion 26 protects the hole as described. The collar may be made of softer materials than the wires, such as brass, by way of example.

In the assembly of the structure described in FIGS. 1 through 3, the mandrel 11 as a separate member will first receive the collar 13 on its upper end. The mandrel and collar can then be inverted and the ring member 20 slid over the mandrel to seat against the collar 13.

Thereafter, the various brush bundles described in FIG. 3 are inserted through the various openings 18 in the semi-cylindrical sections 16 and 17 while they are separated so that easy access is had to the interior walls thereof.

After assembly of the brushes in the semi-cylindrical sections, these sections are brought together about the mandrel 11 into a coaxial relationship therewith and then urged downwardly so that the ends of the semi-cylindrical sections slide under the tapered bore **22*b* of the ring member 20**. Since the mandrel and ring member are upside down, gravity will facilitate the simple sliding of these semi-cylindrical members into the tapered bore of the ring member.

The second ring member 21 shown in the lower portion of FIGS. 1 and 2 is then inserted over the upper end of the mandrel 11 while in its inverted position and its bore **23*b* will surround the ends of the semi-cylindrical sections and hold them in tight engagement about the mandrel 11**.

After the second ring member 21 is in position, suitable washers such as 24 and 25 may be provided to assure that when the collar 14 is threaded onto the mandrel, a tight axial force will be applied against the ring member 21 by the collar. In other words, if the threads of the mandrel terminate before contact is effected between the collar 14 and the ring member 21, the use of the washers 24 and 25 will serve as spacers so that an axial force can be applied by tight threading of the collar 14. This axial force will again cause a radial construction of the ends of the semi-cylindrical section by the tapered bore 23' and will also serve to seat the opposite ends of the semi-cylindrical sections against the annular shoulders 22 and 23 of the ring members.

As already described, when the semi-cylindrical sections are so positioned about the mandrel, the inner ends of the wires in their bent positions and the rivet flanges are trapped between the outer wall 11' of the mandrel and the inner cylindrical walls such as 17' of the semi-cylindrical sections. All of the brush bundles are thus securely held on the mandrel and all of the individual wires making up the brush bundles are protected by the cylindrical portions of the various rivet shaped collars. After assembly of the structure is described, the brush can then be connected into a conventional pipe string such as the pipe string 15 described in FIG. 1 by inverting the assembled brush and threading the collar 13 onto the end of the pipe string.

Disassembly of the structure is accomplished by performing the above-described steps in reverse.

From all of the foregoing, it will now be evident that the present invention has provided a greatly improved well brush. Because of the unique rivet arrangement and bent wires together with the semi-cylindrical sections, a central bore 12 of the mandrel 11 can be of sufficient size to maintain normal circulation or reverse circulation of fluid during a brushing operation. Moreover, by holding the wires by means of having their inner ends bent as described, the risk of structural failure of the wires themselves is minimized since welding or the like for holding the wires is not necessary.

As also described, assembly and disassembly is simplified, the tool is relatively inexpensive to produce, and the various holes in the semi-cylindrical sections are protected from the wire brushes.

I claim:

1. A brush tool for wells including, in combination:

(a) a mandrel for insertion in a well pipestring, said mandrel having a central bore for maintaining well fluid circulation during a brushing operation;

(b) first and second semi-cylindrical sections, each having a plurality of holes along its length;

(c) brush means radially extending through said holes, said first and second sections being dimensioned to surround said mandrel in coaxial relationship when brought together from opposite sides of said mandrel so that the inner ends of the brush means are held secure between the outer wall of the mandrel and the inner walls of the first and second semi-cylindrical sections, said brush means including a brush bundle for each hole comprising a rivet shaped collar and a plurality of wires passing through the collar to make up the brush bundle, said rivet-shaped collar having a cylindrical portion dimensioned to be snugly received in said hole and of an axial length sufficient to hold the wires in a bundle and a radially extending exterior flange at one end overlapping the entrance periphery of the hole, said plurality of wires having their inner ends bent laterally to overlie said flange, said flange and bent wires being trapped between the outer wall of said mandrel and the inner cylindrical wall of the semi-cylindrical section through which said hole passes so that all the brush bundles are securely held on said mandrel, said rivet shaped collar further preventing direct contact of said wires with said holes to thereby minimize wear on said holes; and (d) ring means receivable over the ends of said mandrel to engage about the opposite ends of the semi-cylindrical sections and thereby hold them together about said mandrel whereby rapid assembly and disassembly of the brush means over the length of said mandrel can be realized.

2. A tool according to claim 1, in which each of said ring means comprises a ring member having an interior stepped bore defining an axially facing annular shoulder for seating against the ends of the semi-cylindrical sections when the ring member is received thereover; and wherein said mandrel includes end collars for connection to said pipestring, said end collars retaining the adjacent ring members in place.

3. A tool according to claim 2, in which the larger bore portion between the annular shoulder and end of the ring member surrounding the ends of the semi-cylindrical sections is tapered so as to exert a radial squeezing force on the ends of the sections as the collar is moved axially thereover whereby the sections are secured in tight radial engagement about said mandrel.

4. A tool according to claim 2, including at least one spacing washer receivable between one of said ring members and adjacent collar to allow for axial adjustment of the collar position on the mandrel and thereby enable a tight axial engagement of the collar against the adjacent ring member to be made.

5. A tool according to claim 1, in which each rivet-shaped collar is made of softer material than the wires.

* * * * *